US005296908A

United States Patent [19]

Hatano et al.

[11] Patent Number: 5,296,908

[45] Date of Patent: Mar. 22, 1994

[54] IMAGE PROCESSING MACHINE WITH AN AUTOMATIC SHEET HANDLER

[75] Inventors: Masaru Hatano, Amagasaki; Tsukasa Sugiyama, Moriguchi, both of Japan

[73] Assignee: Mita Industrial Co., Ltd., Osaka, Japan

[21] Appl. No.: 611,785

[22] Filed: Nov. 13, 1990

[30] Foreign Application Priority Data

Nov. 30, 1989 [JP] Japan ..... 1-313244

[51] Int. Cl.[5] ..... G03G 21/00

[52] U.S. Cl. ..... 355/319; 271/186; 271/291; 271/303; 355/23; 355/24; 355/26; 355/320

[58] Field of Search ..... 355/318, 319, 320, 321, 355/23, 26, 25, 24; 271/291, 186, 303, 9

[56] References Cited

U.S. PATENT DOCUMENTS

| | | | |
|---|---|---|---|
| 4,553,828 | 11/1985 | Burger et al. | 355/318 |
| 4,561,765 | 12/1985 | Masuda | 355/320 X |
| 4,629,173 | 12/1986 | Hashimoto et al. | 271/186 X |
| 4,787,616 | 11/1988 | Sasaki et al. | 271/303 X |
| 4,806,979 | 2/1989 | Tokoro et al. | 355/319 |
| 4,980,729 | 12/1990 | Okamoto | 355/320 |
| 4,982,241 | 1/1991 | Okamoto et al. | 355/320 |
| 5,027,162 | 6/1991 | Kida et al. | 355/318 X |

FOREIGN PATENT DOCUMENTS

| | | | |
|---|---|---|---|
| 3718219 | 12/1987 | Fed. Rep. of Germany | 271/186 |
| 60-258564 | 12/1985 | Japan | 355/319 |
| 63-138362 | 6/1988 | Japan | 355/320 |
| 63-165232 | 7/1988 | Japan | 271/186 |

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

A combined system of an image processing machine (e.g., a copying machine) and a sheet handling machine. They are placed with an image reading part (e.g., a glass plate of the copying machine) therebetween. In the combined system, one-sided or two-sided original sheets and processed sheets are orderly stacked on respective final tray after they are finished processing if the original sheets are stacked orderly in the initial tray, i.e., the original sheets are laid on the final tray with the order of the page numbers maintained from the order at the initial tray, and the processed sheets are also stacked on the finish tray with the same order. In a simple mode: the original sheet is placed on the image reading part, processed (copied), reversed and ejected to a first final tray, while the process sheet (copy sheet) is processed and ejected onto the finish tray without reversing. In a reverse mode: an original sheet is first placed on the image reading part, first processed, recycled (reversed), second processed and ejected to a second final tray without reversing, while the process sheet is first processed, recycled (reversed), second processed, reversed and ejected to the finish tray.

6 Claims, 4 Drawing Sheets

FIG. 2A
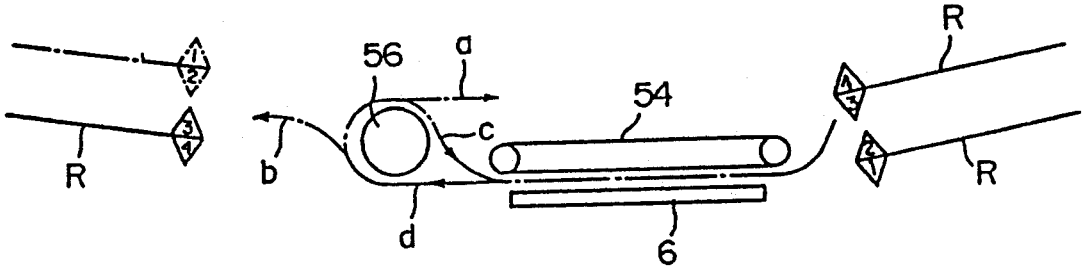
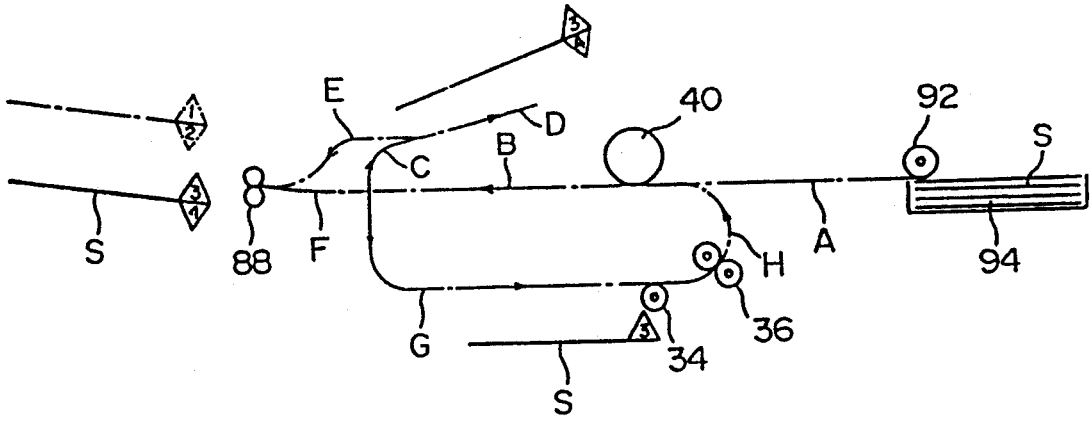
FIG. 2B

FIG. 5A
(Prior Art)
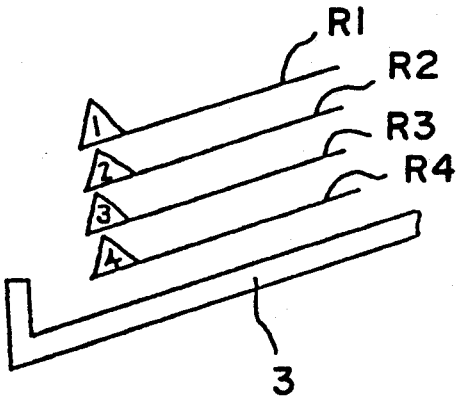
FIG. 5B
(Prior Art)
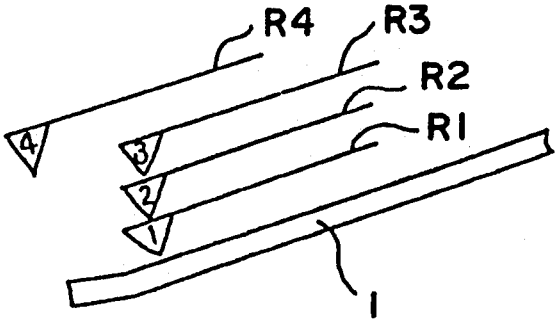
FIG. 6A
(Prior Art)
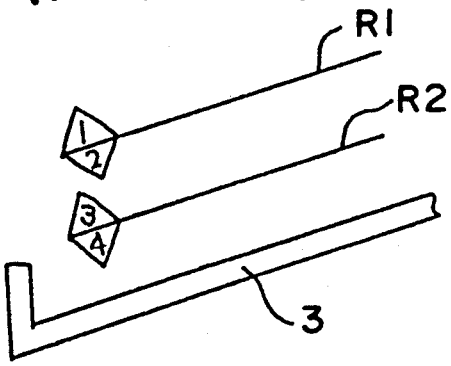
FIG. 6B
(Prior Art)
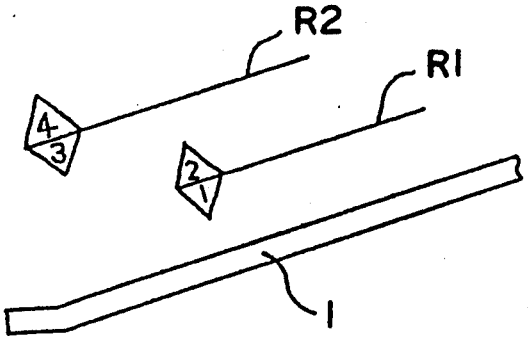
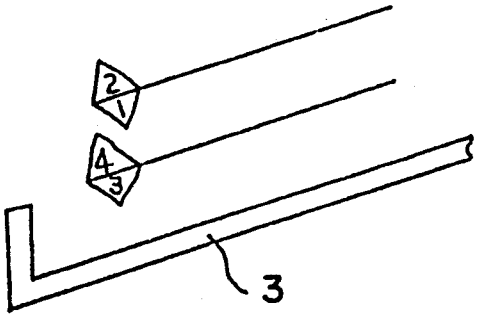
FIG. 7
(Prior Art)

IMAGE PROCESSING MACHINE WITH AN AUTOMATIC SHEET HANDLER

BACKGROUND OF THE INVENTION

1. Field of the Invention

The present invention relates to an image processing machine (such as a copying machine) that can process (e.g., copy on a copy sheet) an image on each side of an original sheet equipped with a document handler that can automatically reverse the original sheet.

2. Related Art

An example of a conventional automatic reversible sheet handler for use with a copying machine is explained according to the Japanese Published Unexamined Patent Application Nos. H1-117167 and H1-167125. The sheet handler includes: an initial tray on which a plurality of original sheets are stacked; a placing mechanism for taking the uppermost sheet of the initial tray and placing it on a contact glass through which the image of the sheet is copied; a sheet remover for removing the sheet from the contact glass; a reverser for reversing the sheet removed from the contact glass and placing it again onto the contact glass; and an ejecting mechanism for reversing the sheet removed from the contact glass and ejecting it to a final tray.

The movement of the sheets in the sheet handler is explained referring to FIGS. 5A, 5B, 6A and 6B. First a "simple mode" function of the sheet handler is explained. In FIG. 5B, four original sheets R1, R2, R3 and R4 are stacked on an initial tray 1, and the printed surface of each sheet is downside (the triangle indicates the printed surface, and the number in the triangle is the page number). When the sheet handler is activated in the simple mode, the uppermost sheet R4 is first taken in and placed on the contact glass. After the printed surface of the sheet R4 is copied, the sheet R4 is removed from the contact glass, reversed upside down, and laid on a final tray 3 (FIG. 5A). The next sheet R3 is similarly carried and laid upon the previous sheet R4 on the final tray 3. Thus, when all the sheets are copied, the sheets are stacked on the final tray 3 as shown in FIG. 5A. Note that the page order of the original sheets on the initial tray 1 is maintained on the final tray 3.

In a "reverse mode", a plurality of (two in the case of FIG. 6A and 6B) two-sided (i.e., each side of the sheet is printed) sheets R1 and R2 are stacked as shown in FIG. 6B on the initial tray 3. When the sheet handler is activated in the reverse mode, the uppermost sheet R2 is first taken out from the initial tray 1 and, not directly placing it on the contact glass, but reversed upside down before placing it on the contact glass. After the page 4 of the sheet R2 is first copied on the contact glass, the sheet R2 is reversed and the page 3 is copied. When the sheet R2 is removed from the contact glass after the both surfaces are copied, the sheet R2 is further reversed and laid on the final tray 3. As shown in FIG. 6A, page 4 of the sheet R2 faces down on the final tray 3. The next sheet R1 is similarly handled and laid onto the previous sheet R2 on the final tray 3 as shown in FIG. 6A. In this mode also the page order of the original sheets on the initial tray 1 is maintained on the final tray 3.

As explained above, when two-sided sheets are handled by the conventional sheet handler, every sheet is reversed three times in order to maintain the page order. Such sheet handler does not match a high speed copying machine.

An improvement addressing the problem is made in Japanese Patent Application No. H1-192544, in which the improved sheet handler includes: an initial tray on which a plurality of original sheets are stacked; a placing mechanism for taking the uppermost sheet on the initial tray and placing it on a contact glass through which the contact surface (downward surface) of the sheet is copied; a reverser for reversing the sheet removed from the contact glass and placing it again onto the contact glass; and an ejecting mechanism for removing the sheet from the contact glass and either a) ejecting the sheet onto a first final tray after reversing or b) ejecting the sheet onto a second final tray without reversing. The sheet handler can also operate in a simple mode or in a reverse mode. In the simple mode, an original sheet on the initial tray is placed on the contact glass and the contact surface of the sheet is copied. Then the sheet is reversed after it is removed from the contact glass, and ejected onto the first final tray. In the reverse mode, a sheet on the initial tray is placed on the contact glass and the contact surface of the sheet is copied. After the first surface is copied, the sheet is reversed upside down to make the second surface face the contact glass and the second surface is copied. After both surfaces are copied, the sheet is ejected onto the second final tray without reversing. In the reverse mode, the finished original sheets stacked on the second final tray maintain the original page order at the initial tray.

The sheet handler is improved in the treating time, but it has a drawback. The order of copying operation is irregular, i.e., the copying order will be as [page 3→page 4→page 1→page 2] if the two-sided original sheets are naturally prepared as shown in FIG. 6B on the initial tray 1.

SUMMARY OF THE INVENTION

An object of the present invention is to provide an improved system of a sheet handler and a copying machine (or generally, an image processing machine including a copying machine, an image recorder, etc.) in which the sheet handling time is short and orderly paged copied sheets can be obtained as well as orderly paged finished original sheets.

The system according to the invention is a system of an image processing machine and an original-sheet handling machine placed adjacent with an image reading part therebetween. The system comprises:

an initial tray provided in the original-sheet handling machine for laying a plurality of original sheets;

a placing mechanism provided in the original-sheet handling machine for taking the uppermost one of the plurality of original sheets on the initial tray and placing the original sheet on the image reading part;

a first recycling mechanism provided in the original-sheet handling machine for removing the original sheet from the image reading part, reversing the original sheet and replacing the original sheet on the image reading part;

a first ejecting mechanism provided in the original-sheet handling machine for ejecting the original sheet on the image reading part either with reversing to a first final tray or without reversing to a second final tray;

a processing section provided in the image processing machine for processing a surface of a process sheet according to a surface of the original sheet placed on the image reading part;

a second recycling mechanism provided in the image processing machine for transporting the process sheet processed at the processing section again to the processing section with the processed surface upside down;

a second ejecting mechanism provided in the image processing machine for ejecting the process sheet processed at the processing section onto a finish tray;

a reversing mechanism provided in the image processing machine for reversing the process sheet upside down before the process sheet is ejected by the second ejecting mechanism; and a controller for controlling the movement of the original sheet in synchronism with the movement of the process sheet.

Other features of the present invention is shown in the detailed description of an embodiment that follows.

BRIEF DESCRIPTION OF THE ATTACHED DRAWINGS

FIGS. 2A and 2B are illustrative diagrams showing the flow of an original sheet and a copy sheet respectively in the sheet handler (FIG. 2A) and in the copying machine (FIG. 2B).

FIGS. 5A and 5B are illustrative diagrams showing how original sheets are stacked on the initial tray (FIG. 5B) and on the final tray (FIG. 5A) in the simple mode of a conventional sheet handler.

FIGS. 6A and 6B are illustrative diagrams showing how two-sided original sheets are stacked on the initial tray (FIG. 6B) and the final tray (FIG. 6A) in the reverse mode of the conventional sheet handler.

FIG. 7 is an illustrative diagram showing an irregular stack of original sheets on the final tray of the conventional sheet handler.

DETAILED DESCRIPTION OF THE PREFERRED EMBODIMENT

Figure 1:
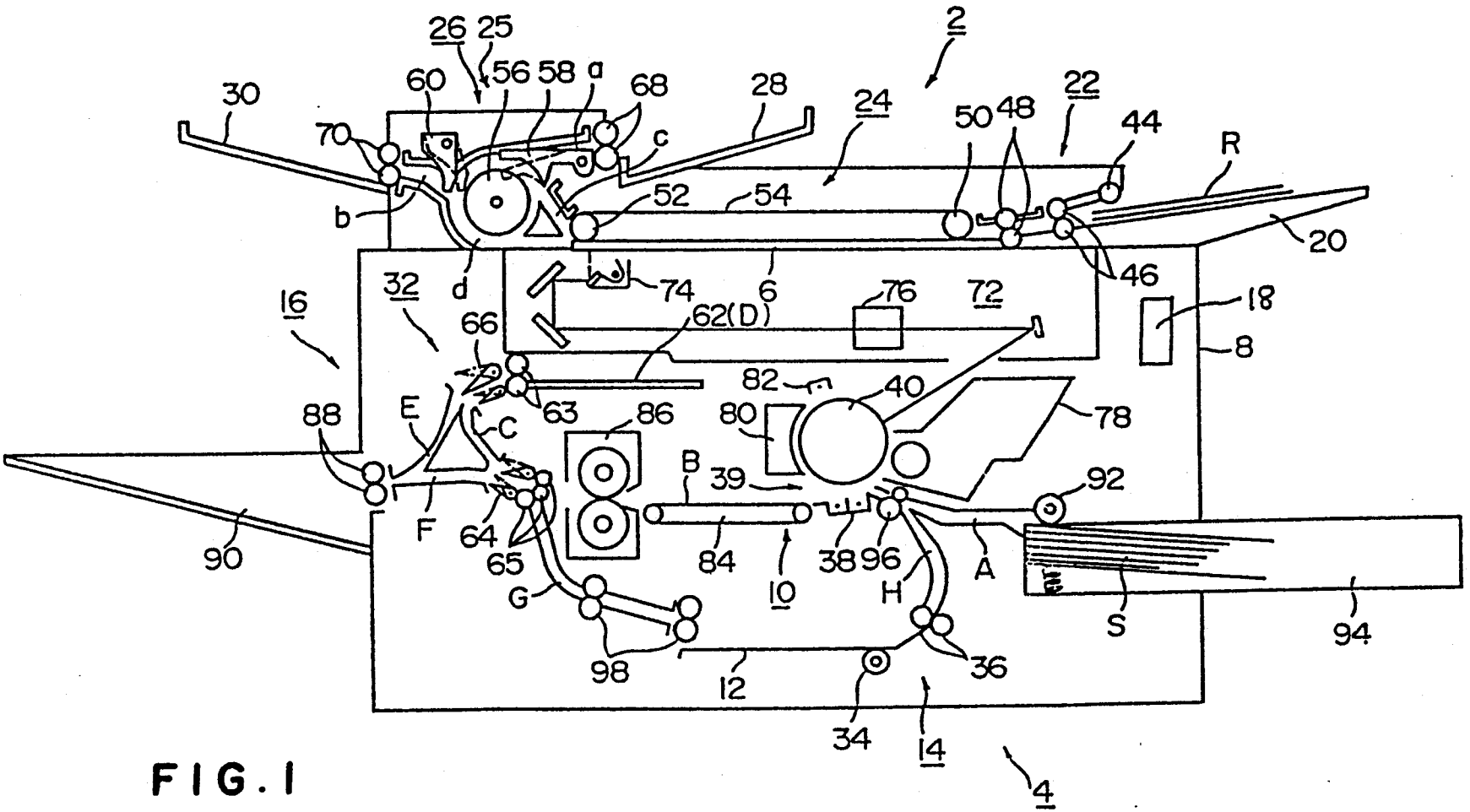
FIG. 1 is cross-sectional view of a two-side copying machine equipped with an automatic reversible sheet handler as an embodiment of the present invention.

A combined system of a copying machine and an automatic sheet handler is now explained as an embodiment of the present invention. The copying machine can print copies on both sides of a copy sheet, and the sheet handler can accordingly reverse a two-sided original sheet. First the mechanical structure of the system is explained referring to FIG. 1. As shown in FIG. 1, the automatic sheet handler 2 is placed on top of the copying machine 4. Between the sheet handler 2 and the copying machine 4 is provided a glass plate 6 fixed on top of the housing 8 of the copying machine 4 on which an original sheet is placed and copied.

In the housing 8 of the copying machine 4, a drum 40 with a photoconductive material on the surface is provided. Around the drum 40 are placed clockwise from the top: a main charger 82, a developer 78, a transferring/separating charger 38 and a cleaner 80. Above the drum 40 and under the glass plate 6 is provided an optical system 72 including a light source 74 and a lens 76. The optical system 72 scans through an original R placed on the glass plate 6 and the optical image of the original is cast onto the surface of the drum 40 (which is previously charged by the main charger 82) to produce a latent image on the charged surface. The latent image is developed by toner powder transferred from the developer 78, and the toner image is transferred to a copy sheet S (which can be a sheet or plain paper) by the transferring/separating charger 38. The toner remaining on the drum 40 is removed by the cleaner 80.

At the right hand side of the housing 8 is provided a sheet cassette 94 for containing a plurality of copy sheets, and at the left hand side is provided a finish tray 90 for receiving copied sheets (copy sheets S that have been copied). Between the sheet cassette 94 and the finish tray 90, there are provided an image processing section 10 and a sheet handling section 16 in the housing 8. The sheet handling section 16 handles the copied sheet S two ways: in one way the copied sheet S is ejected out of the housing 8 to the finish tray 90, and in the other way the copied sheet S is stored on a cache plate 12 provided in the housing 8.

The image processing section 10 includes, besides the drum 40 and the peripheral units above described, a pair of resist rollers 96 for bringing a copy sheet S to an image transferring part 39, a conveyer 84 for conveying the image-transferred (copied) sheet S to a fixer 86, and the fixer 86. The sheet handling section 16 is placed at the downstream of the fixer 86, and includes: divider rollers 65 (which is composed of three rollers), a pair of ejecting mechanism rollers 88 for ejecting the copied sheet S out of the housing 8, conveyer rollers 98 for conveying the copied sheet S to the cache plate 12, and a reverser 32. The reverser 32 includes: a pair of first guide plates 64, a temporary shelf 62, a pair of second guide plates 66, and a pull-out rollers 63. The first guide plates 64 rotate between two positions: the first position for guiding the copied sheet S directly to the finish tray 90 (leftward), and the second position for guiding the sheet S to the temporary shelf 62 (upward). The second guide plates 66 also rotate between two positions: the first position (downward) for guiding the sheet S guided by the first guide plates 64 in the second position to the temporary shelf 62, and a second position (leftward) for guiding the sheet S on the temporary shelf 62 to the finish tray 90. When the second guide plates 66 are in the first position and the first guide plates 64 are in the second position, the sheet S on the temporary shelf 62 is guided downward to the cache plate 12. When the sheet S is to be retrieved from the temporary shelf 62, the pull-out rollers 63 rotate in normal direction, and when the sheet S is to be brought to the temporary shelf 62, the pull-out rollers 63 rotate in reverse direction.

The cache plate 12 is provided under the image processing section 10. A recycling mechanism 14 is provided at the other end of the cache plate 12 opposing to the end where the copied sheet S is brought in by the reverse 32. The recycling mechanism 14 includes a pull-out roller 34 and a pair of pull-up rollers 36 to bring the sheet S on the cache plate 12 to the resist rollers 96. Thus a recycle path is formed in which the copied sheet S is once brought to the cache plate 12 and then retrieved to the image transferring part 39.

The automatic sheet handler 2 is now explained. The automatic sheet handler 2 includes: an initial tray 20, a taking-in mechanism 22, a parallel transporting mechanism 24, a recycling mechanism 25, and an ejecting mechanism 26. The original sheets R are placed on the initial tray 20 with the printed surface downward and the sheet with smaller page number comes more downward. When two-sided original sheets R are handled (i.e., both surfaces of the original sheets R are to be copied), surface with the smaller page number comes downward. That is, in any case, the page numbers are ordered from bottom to top on the initial tray 20. The uppermost original sheet R on the initial tray 20 is pulled into the handler housing by a roller 44 of the taking-in mechanism 22. A pair of separator rollers 46 are provided in the taking-in mechanism 22 to prevent sheets other than the uppermost sheet R from coming into the handler housing. A pair of transportation rollers 48 feed the sheet R to the parallel transporting mechanism 24. The parallel transporting mechanism 24 is composed of an endless flat belt 54 hung between a driving roller 52 and a driven roller 50, and places the sheet R to a predetermined place of the glass plate 6. After the sheet R is copied on the glass plate 6, the sheet R is pulled out leftward by the parallel transporting mechanism 24 from the glass plate 6 and is handed to the ejecting mechanism 26 or the recycling mechanism 25. The recycling mechanism 25 includes an inlet path d, a large reversing roller 56, and a returning path c for conducting the sheet R again onto the glass plate 6. When the original sheet R is handed to the recycling mechanism 25, the sheet R is reversed upside down and again placed at the predetermined place of the glass plate 6 by the parallel transporting mechanism 24 for the second time copying.

When the original sheet R is handed to the ejecting mechanism 26, the sheet R is conducted in two ways. In the first way the sheet R is dragged by the large roller 56 half-round through the path d, guided out of the handler housing by a guide plate 58 and ejected out by a pair of rollers 68 onto a first final tray 28 through a path a. In the second way the sheet R is dragged leftward by the large roller 56 through the path d, guided by a second guide plate 60 to the outlet b of the handler housing and ejected out by a pair of rollers 70 onto a second final tray 30. The first guide plate 58 and the second guide plate 60 normally rest as shown by the solid line in FIG. 1 (first position) to reverse the sheet R and re-place the sheet R onto the glass plate 6. When the second guide plate 60 is rotated to the dashed line position (second position), the sheet R is ejected to the second final tray 30 without reversing. In the above mechanism of the automatic sheet handler 2, the reverser 25 and the ejecting mechanism 26 are both placed at the left end of the glass plate 6 to commonly use a part of the mechanisms, which can make the sheet handler compact and low-cost. Of course they are placed separately, such as the reverser 25 is to the right of the glass plate 6 and the ejecting mechanism 26 is to the left.

The operations of both the copying machine 4 and the automatic sheet handler 2 are controlled by a controller 18 provided in the copying machine 4. The operations are explained referring to FIGS. 2A–4B.

SIMPLE MODE

Figure 3A:
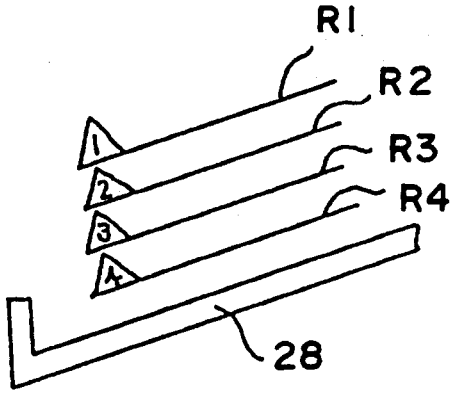
FIGS. 3A and 3B are illustrative diagrams showing how original sheets are stacked on the initial tray (FIG. 3B) and on the final tray (FIG. 3A) in the simple mode of the embodiment.
Figure 3B:
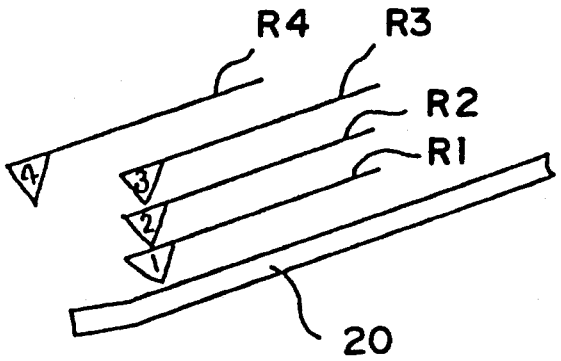

Originals with only one printed surface are treated in the simple mode. Suppose four sheets of originals R1, R2, R3 and R4 are stacked on the initial tray 20 with the printed surfaces downward as shown in FIG. 3B. The sheets R1, R2, R3 and R4 are orderly placed on the initial tray 20 from bottom to top, i.e., the first page is at the bottom and the last (fourth) page is at the top. When the automatic sheet handler is activated, the uppermost sheet R4 is pulled into the handler housing by the taking-in mechanism 22 and placed on the glass plate 6 by the parallel transporting mechanism 24. After a copying operation of the printed surface of the sheet R4 (page 4) is finished, the sheet R4 is removed from the glass plate 6 by the parallel transporting mechanism 24 and ejected onto the first final tray 28 by the ejecting mechanism 26 with the printed surface upward (i.e., reversed). The following sheets R3, R2 and R1 are similarly handled and laid on the first tray 28. Thus the finished original sheets R1, R2, R3 and R4 are also stacked orderly on the first final tray 28 as shown in FIG. 3A.

The copying machine 4 operates in coordination with the automatic sheet handler 2. A sheet of plain paper (copy sheet) S is drawn into the housing 8 from the sheet cassette 94 by a friction roller 92 and brought to the resist rollers 96 through an inlet path A. In synchronism with the scanning of the first original R4 (page 4) on the glass plate 6, the copy sheet S is fed to the transferring part 39 by the resist rollers 96. After the toner image on the drum 40 is transferred to the copy sheet S, the sheet (copied sheet) S is conveyed through a path B to the fixer 86 where the toner image is fixed. The copied sheet S is pulled by the rollers 65, conducted leftward by the first guide plates 64 at the first position through path F and ejected from the housing 8 onto the finish tray 90 without reversing. Thus the copied surface of the sheet S is upward on the finish tray 90. The following copies for the originals R3, R2 and R1 (pages 3, 2 and 1) are performed similarly and thus the copied sheets S are orderly stacked on the finish tray 90 just the same as the originals R4, R3, R2 and R1 as shown in FIG. 3A.

REVERSE MODE

Figure 4A:
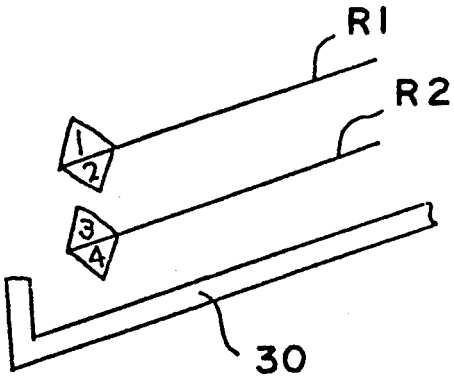
FIGS. 4A and 4B are illustrative diagrams showing how two-sided original sheets are stacked on the initial tray (FIG. 4B) and the final tray (FIG. 4A) in the reverse mode of the embodiment.
Figure 4B:
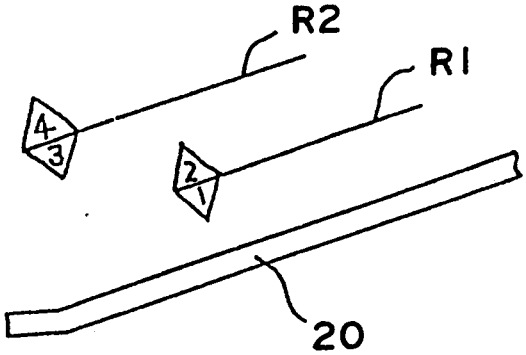

When original sheets with printing on both surfaces are to be copied for the both surfaces, a reverse mode is used. The two-sided original sheets R1 and R2 are stacked in the initial tray 20 with the smaller page number downward throughout the sheets as shown in FIG. 4B. When the automatic sheet handler 2 is activated, the uppermost sheet R2 is drawn into the handler housing by the taking-in mechanism 22 and placed onto the predetermined place of the glass plate 6 by the parallel transporting mechanism 24. Here page 3 faces downward to the glass plate 6. After page 3 is copied, the original sheet R2 is removed from the glass plate 6 by the parallel transporting mechanism 24, reversed by the reverser 25 and then placed on the predetermined place of the glass plate 6 again to be copied for the page 4. After page 4 is copied, the original sheet R2 is removed from the glass plate 6 by the parallel transporting mechanism 24 and ejected to the second final tray 30 by the ejecting mechanism 26 without reversing. The following original sheet R1 is similarly handled and laid upon the first sheet R2 on the second final tray 30. After all the copying is finished, the original sheets R1 and R2 are stacked on the second final tray 30 as shown in FIG. 4A, where the page order of the sheets R1 and R2 is maintained from that on the initial tray 20. The movement of the original sheet R is illustrated in FIG. 2A.

The copying machine 4 operates as follows in the reverse mode. When the automatic sheet handler 2 is activated, a copy sheet S is drawn into the housing 8 from the sheet cassette 94 by the roller 92 and brought to the resist rollers 96 through the inlet path A. In synchronism with the scanning of the first surface (page 3) of the first original sheet R2 on the glass plate 6, the copy sheet S is fed to the transferring part 39 by the resist rollers 96. After the toner image on the drum 40 is transferred to the sheet S, the sheet S is conveyed through the path B to the fixer 86 where the toner image is fixed. The copied sheet S is pulled by the rollers 65, conducted upward by the first guide plates 64 at the second position and conducted through path C to the temporary shelf (D) 62 by the second guide plates 66 at the first position. Then the sheet S is retrieved from the temporary shelf 62 by the rollers 63 and conducted through the path C and path G to the cache plate 12. In the process, the sheet S is not reversed, i.e., the copied surface is upward on the cache plate 12. While the original sheet R2 is reversed and the second page (page 4) is put faced on the glass plate 6 in the automatic sheet handler 2, the sheet S on the cache plate 12 is pulled out by the rollers 34 and 36 and brought through path H to the resist roller 96. Then the toner image of page 4 is transferred to the other surface (i.e., the blank surface reverse to the surface that has been already copied) of the sheet S at the transferring part 39. After the toner image is fixed at the fixer 86, the two-side copied sheet S is reversed upside down and ejected to the finish tray 90 of the copying machine 4. To be detailed, the copied sheet S is pulled by the rollers 65 and guided upward by the first guide plates 64 at the second position, through path C and by the second guide plates 66 at the first position to the temporary shelf 62. Then the sheet S is retrieved from the temporary shelf 62 by the rollers 63, is guided leftward by the second guide plates 66 turned to the second position, passes through path E and ejected by the rollers 88 onto the finish tray 90. Since the sheet S is reversed after the second surface (page 4) is copied, the sheet S is placed on the finish tray 90 so that the page 4 faces downward and page 3 faces upward. The movement of the copied sheet S is illustrated in the FIG. 2B. The following copy sheet S corresponding to the second original sheet R1 is treated similarly, and laid on the first copy sheet S on the finish tray 90 with the page 2 downward and page 1 upward. Thus after finishing the copying operation of all the pages of the original sheets R2 and R1, the copied sheets S are stacked on the finish tray 90 in the same order as the original sheets R1 and R2 before copying and after copying.

What is claimed is:

1. A system of an image processing machine and an original-sheet handling machine placed adjacent with an image reading part therebetween, the system comprising:

an initial tray provided in the original-sheet handling machine for laying a plurality of original sheets;

a placing mechanism provided in the original-sheet handling machine for taking an uppermost one of a plurality of original sheets in the initial tray and placing an original sheet on the image reading part by conveying it from one end of the image reading part;

a first recycling mechanism provided at the opposite side of the image reading part with respect to the initial tray in the original-sheet handling machine for removing an original sheet from the image reading part, reversing an original sheet and replacing an original sheet on the image reading part by conveying it from the opposite side of the image reading part, the first recycling mechanism including a large reversing roller by which an original sheet removed from the image reading part is reversed and replaced on the image reading part;

a first ejecting mechanism provided in the original-sheet handling machine for ejecting an original sheet on the image reading part either with reversing to a first final tray or without reversing to a second final tray;

a processing section provided in the image processing machine for processing a surface of a process sheet according to a surface of the original sheet placed on the image reading part;

a second recycling mechanism provided in the image processing machine for transporting a process sheet processed at the processing section again to the processing section with a processed surface upside down;

a second ejecting mechanism provided in the image processing machine for ejecting a process sheet processed at the processing section onto a finish tray;

a reversing mechanism provided in the image processing machine for reversing a process sheet upside down before a process sheet is ejected by the second ejecting mechanism; and a controller for controlling the movement of an original sheet in synchronism with the movement of a process sheet.

2. The system according to claim 1, where the system has two working modes:

one being a simple mode in which an original sheet is placed on the image reading part by the placing mechanism and ejected to the first final tray after reversal by the first ejecting mechanism, and a process sheet is processed at the processing section and ejected onto the finish tray without reversal by the second ejecting mechanism; and the other being a reverse mode in which an original sheet is first placed on the image reading part by the placing mechanism, recycled by the first recycling mechanism, and ejected to the second final tray without reversing, and a process sheet is first processed at the processing section, recycled by the second recycling mechanism, second processed at the processing section, reversed by the reversing mechanism, and ejected to the finish tray by the second ejecting mechanism.

3. A system of a copying machine and an original-sheet handling machine placed adjacent with a contact plate therebetween, the system comprising:

an initial tray provided in the original-sheet handling machine for laying a plurality of original sheets;

a placing mechanism provided in the original-sheet handling machine for taking an uppermost one of the plurality of original sheets on the initial tray and placing an original sheet on the contact plate by conveying it from one end of the contact plate;

a first recycling mechanism provided at the opposite side of the contact plate with respect to the initial tray in the original-sheet handling machine for removing an original sheet from the contact plate, reversing an original sheet and replacing an original sheet on the contact plate by conveying it from the opposite side of the contact plate, the first recycling mechanism including a large reversing roller by which an original sheet removed from the contact plate is reversed and replaced on the contact plate;

a first ejecting mechanism provided in the original-sheet handling machine for ejecting an original sheet on the contact plate either with reversing to a first final tray or without reversing to a second final tray;

a copying section provided in the copying machine for copying a surface of an original sheet placed on the contact plate to a surface of a copy sheet;

a second recycling mechanism provided in the copying machine for transporting a copy sheet copied at the copying section again to the copying section with a copied surface upside down;

a second ejecting mechanism provided in the copying machine for ejecting a copy sheet copied at the copying section onto a finish tray;

a reversing mechanism provided in the copying machine for reversing a copy sheet upside down before a copy sheet is ejected by the second ejecting mechanism; and a controller for controlling the movement of an original sheet in synchronism with the movement of a copy sheet.

4. The system according to claim 3, where the system has two working modes:

one being a simple mode in which an original sheet is placed on the contact plate by the placing mechanism and ejected to the first final tray after reversal by the first ejecting mechanism, and a copy sheet is copied at the copying section and ejected onto the finish tray without reversal by the second ejecting mechanism; and the other being a reverse mode in which an original sheet is first placed on the contact plate by the placing mechanism, recycled by the first recycling mechanism, and ejected to the second final tray without reversing, and a copy sheet is first copied at the copying section, recycled by the second recycling mechanism, second copied at the copying section, reversed by the reversing mechanism and ejected to the finish tray by the second ejecting mechanism.

5. A system of an image processing machine and an original-sheet handling machine placed adjacent with an image reading part therebetween, the original-sheet handling machine being operable in a simple mode for processing a process sheet based upon a single surface of an original sheet, and a reverse mode for processing a process sheet based upon a reverse surface of an original sheet, the system comprising:

an initial tray provided in the original-sheet handling machine for laying a plurality of original sheets;

a placing mechanism provided in the original-sheet handling machine for taking an uppermost one of a plurality of original sheets in the initial tray and placing an original sheet on the image reading part by conveying it from one end of the image reading part in a same direction for both said simple mode and said reverse mode;

a first recycling mechanism provided at the opposite side of the image reading part with respect to the initial tray in the original-sheet handling machine for removing an original sheet from the image reading part, reversing an original sheet and replacing an original sheet on the image reading part by conveying it from the opposite side of the image reading part;

a first ejecting mechanism provided in the original-sheet handling machine for ejecting an original sheet on the image reading part either with reversing to a first final tray or without reversing to a second final tray;

a processing section provided in the image processing machine for processing a surface of a process sheet according to a surface of the original sheet placed on the image reading part;

a second recycling mechanism provided in the image processing machine for transporting a process sheet processed at the processing section again to the processing section with a processed surface upside down;

a second ejecting mechanism provided in the image processing machine for ejecting a process sheet processed at the processing section onto a finish tray;

a reversing mechanism provided in the image processing machine for reversing a process sheet upside down before a process sheet is ejected by the second ejecting mechanism; and a controller for controlling the movement of an original sheet in synchronism with the movement of a process sheet.

6. The system according to claim 5, wherein in said simple mode, an original sheet is placed on the image reading part by the placing mechanism and ejected to the first final tray after reversal by the first ejecting mechanism, and a process sheet is processed at the processing section and ejected onto the finish tray without reversal by the second ejecting mechanism; and in said reverse mode, an original sheet is first placed on the image reading part by the placing mechanism, recycled by the first recycling mechanism, and ejected to the second final tray without reversal, and a process sheet is first processed at the processing section, recycled by the second recycling mechanism, second processed at the processing section, reversed by the reversing mechanism, and ejected to the finish tray by the second ejecting mechanism.

* * * * *